US007000859B2

(12) United States Patent
Tuovinen

(10) Patent No.: US 7,000,859 B2
(45) Date of Patent: Feb. 21, 2006

(54) GRINDING ELEMENT AND GRINDER STONE

(75) Inventor: Olli Tuovinen, Tampere (FI)

(73) Assignee: Metso Paper Inc., Helsinki (FI)

( * ) Notice: Subject to any disclaimer, the term of this patent is extended or adjusted under 35 U.S.C. 154(b) by 182 days.

(21) Appl. No.: 10/662,630

(22) Filed: Sep. 15, 2003

(65) Prior Publication Data

US 2004/0250897 A1 Dec. 16, 2004

Related U.S. Application Data

(63) Continuation of application No. PCT/FI02/00218, filed on Mar. 15, 2002.

(30) Foreign Application Priority Data

Mar. 16, 2001 (FI) ..... 20010535

(51) Int. Cl.
*B02C 19/00* (2006.01)

(52) U.S. Cl. ..... 241/294; 241/280; 241/300

(58) Field of Classification Search ..... 241/293, 241/294, 295, 280, 281, 282
See application file for complete search history.

(56) References Cited

FOREIGN PATENT DOCUMENTS

| | | |
|---|---|---|
| DE | 34 13 890 | 10/1984 |
| DE | 43 04 128 A1 | 8/1993 |

*Primary Examiner*—Mark Rosenbaum
(74) *Attorney, Agent, or Firm*—Alston & Bird LLP

(57) ABSTRACT

The invention relates to a grinding element, which comprises a substantially planar fastening frame, and where two or more grinding segments made of grinding ceramic material are fastened to the outer surface of the frame by means of bonding agent. The fastening frame preferably comprises at least one fastening hole, and a fastening bolt is supplied through the hole to fasten the grinding element to the frame of the grinder stone. The invention further relates to a grinder stone, where a grinding surface is formed by arranging a required number of grinding elements according to the invention on the outer circumference of the stone's frame.

18 Claims, 4 Drawing Sheets

GRINDING ELEMENT AND GRINDER STONE

CROSS-REFERENCE TO RELATED APPLICATIONS

Figure 1:
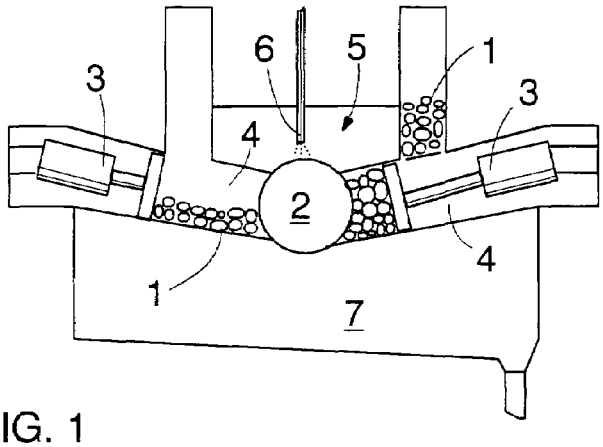
FIG. 1 Prior Art

This application is a continuation of International Patent Application PCT/FI02/00218 filed Mar. 15, 2002, which designated the United States and was published under PCT Article 21(2) in English, and which is hereby incorporated herein in its entirety by reference.

BACKGROUND OF THE INVENTION

1. Field of the Invention

The invention relates to a grinding element, which can be arranged on the outer surface of a frame of a grinder stone used to defiber wood, the grinding element comprising at least one grinding segment made of grinding ceramic material, and fastening means for fastening the element.

The invention further relates to a grinder stone for defibering wood, comprising a cylindrical frame, grinding segments made of grinding ceramic material and arranged on the outer circumference of the grinder stone, and a shaft, around which the grinder stone is arranged to be rotated during grinding.

2. Description of Related Art

Wood is typically ground into fibers by means of grinding machines, where logs are pressed against the surface of a rotating grinder stone. Water is simultaneously sprayed to purify and cool the grinder stone. The stone makes the wood fiber matrix vibrate, whereafter the wood fibers are released from the logs to provide a pulp suspension.

The frame of the grinder stone is usually made of concrete, but steel frames have also been developed. A grinding surface of the grinder stone consists of separate ceramic grinding segments attached to the frame. The grinding segments are attached by various mechanisms, which press each segment separately against the outer circumference of the grinder stone. During use, the grinding segments are subjected to a force, which acts parallel to the tangent of the grinder stone and tends to detach the segments. Furthermore, rotating the grinder stone subjects each segment to a centrifugal force, wherefore the segments must be firmly secured.

Due to different thermal expansion coefficients of the ceramic segment, the frame of the grinder stone, and the fastening bolts, the prior art teaches fastening bolts, which can be used to compensate for varying dimensions resulting from changes in the temperature. However, such bolts are rather complicated and therefore also expensive. Furthermore, it is possible to place semi-spherical washers between the bolt and the segment in order that the stresses resulting from the fastening will be distributed more evenly in the ceramic segment and the segment will thus be able to withstand the fastening forces. Another problem with the present arrangements is that the fastening forces subject the ceramic segment to compression stress, which can break the segment usually from below the washer. It is thus necessary to restrict the fastening force, which in some cases can lead to insufficient fastening of the segment. During grinding, such a loose segment starts vibrating and will be damaged. The ceramic materials used in grinding are highly wear-resistant and hard, yet brittle. However, in practice grinding segments cannot be manufactured from more resistant ceramic materials, since the ceramic material used in grinding of wood must be of a particular type and sufficiently porous to provide a desired grinding effect. Also, quality characteristics set for mechanical pulp require use of the present grinding ceramic materials.

Yet another problem with the present grinding segments is that replacing the segments is difficult and slow.

BRIEF SUMMARY OF THE INVENTION

An objective of the present invention is to provide a new and improved grinding element and grinder stone for defibering wood.

A grinding element according to the invention is characterized in that the grinding element comprises a fastening frame with a first surface and a second surface opposite to the first surface, the first surface being arrangeable against the frame of the grinder stone, that the area of the second surface of the fastening frame is greater than the area of an individual grinding segment, that two or more grinding segments are fastened by means of bonding agent to the second surface of the fastening frame, such that the grinding segments cover together substantially the entire second surface of the grinding element and form a grinding surface of the element, and that the fastening frame of the grinding element is provided with fastening means for fastening the element to the frame of the grinder stone.

Further, a grinder stone according to the invention is characterized in that the outer circumference of the grinder stone is provided with substantially adjacent grinding elements, which constitute a grinding surface of the stone, that each grinding element comprises a substantially planar fastening frame with a first surface and a second surface opposite to the first surface, the first surface being arranged against the frame of the grinder stone, that two or more grinding segments are fastened by means of bonding agent to the second surface of the fastening frame, such that said grinding segments cover together substantially the entire second surface of the grinding element and form a grinding surface, and that the grinding element is fastened to the frame of the grinder stone by fastening means provided in the fastening frame.

According to a basic idea of the invention, two or more grinding segments manufactured of grinding ceramic material are attached by means of bonding agent to the fastening frame of the grinding element in order to form a grinding surface of the element. The area of an individual grinding segment is smaller than the area of the fastening frame, wherefore several grinding segments are required to cover the outer surface of the fastening frame. The fastening frame is preferably a substantially planar element. Grinding elements formed in this manner are positioned adjacent to one another on the outer circumference of the frame of the grinder stone so as to form a desired grinding surface. Each element is fastened by one or more fastening means to the stone's frame. Since the grinding element comprises several smaller and lighter grinding segments than previously, the centrifugal force acting on an individual segment is lower than in the prior art arrangements. Furthermore, small segments are easier to manufacture than large segments, since small segments are not subjected to such high stresses as large segments during the firing of the ceramic material. Correspondingly, changes in the temperature during use, and the resulting stresses can be controlled better in small segments. Also, the area of fastening of the segments with respect to the segment's weight is greater than previously, which guarantees tight fastening of the segment. Compared to grinding segments that are fastened individually, the grinding element according to the invention can be installed in a substantially faster and easier manner. Another advantage is that a sufficiently high fastening force can be selected without a risk of damage to the ceramic segment.

Furthermore, a basic idea of a preferred embodiment of the invention is that the fastening frame of the grinding element is made of plastic. The fastening frame can also be provided with a firm fastening sleeve made of metal or the like, which is arranged in connection with a fastening hole of the grinding element and transmits the fastening force of a fastening bolt to the frame of the grinder stone. It is thus possible to select a sufficiently high fastening force without a risk of damage to the plastic frame. The plastic frame can be manufactured rapidly and at low cost for example by die-casting. The plastic fastening frame is also light and thus easy to handle during assembly. Moreover, since the fastening frame is light, it is subjected to a lower centrifugal force, which reduces the stress on the fastening means.

Yet another basic idea of a preferred embodiment of the invention is that the grinder stone is formed of at least two grinding elements. A grinding element can be made sufficiently strong for this purpose, even though the element consists of small segments. The segments according to the invention are fastened as firmly to a small grinding element as to a large grinding element. This arrangement substantially expedites the replacement of elements compared to the replacement of the previous small grinding segments.

It should be mentioned that in the present application the term 'grinder stone' refers to the stone's frame and the assembly of the grinding elements and fastening means arranged thereto.

BRIEF DESCRIPTION OF THE SEVERAL VIEWS OF THE DRAWING(S)

Figure 2:
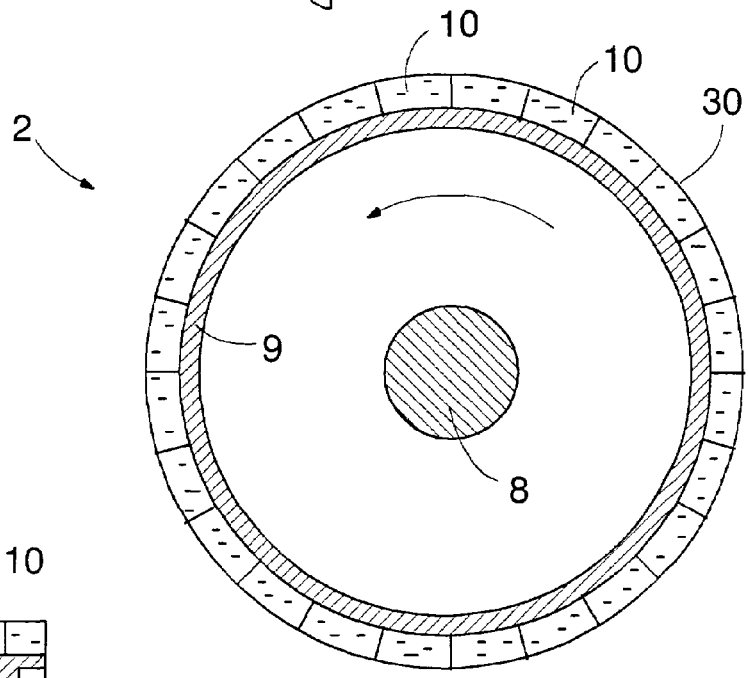
Figure 3:
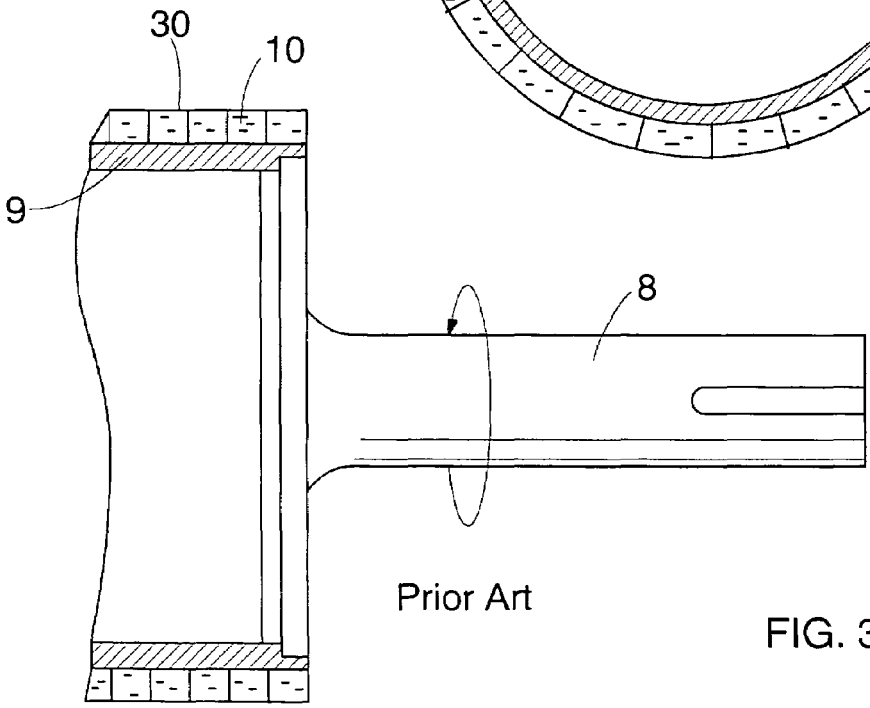
Prior Art FIG. 3
Figure 4:
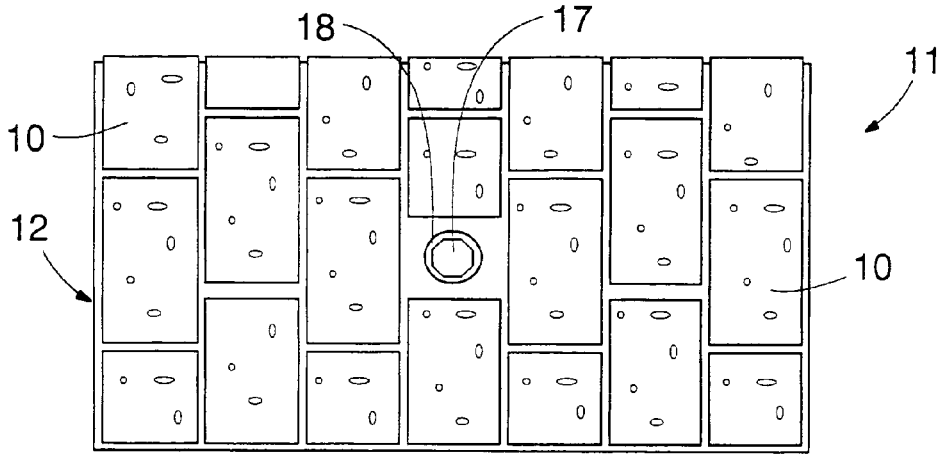
Figure 10:
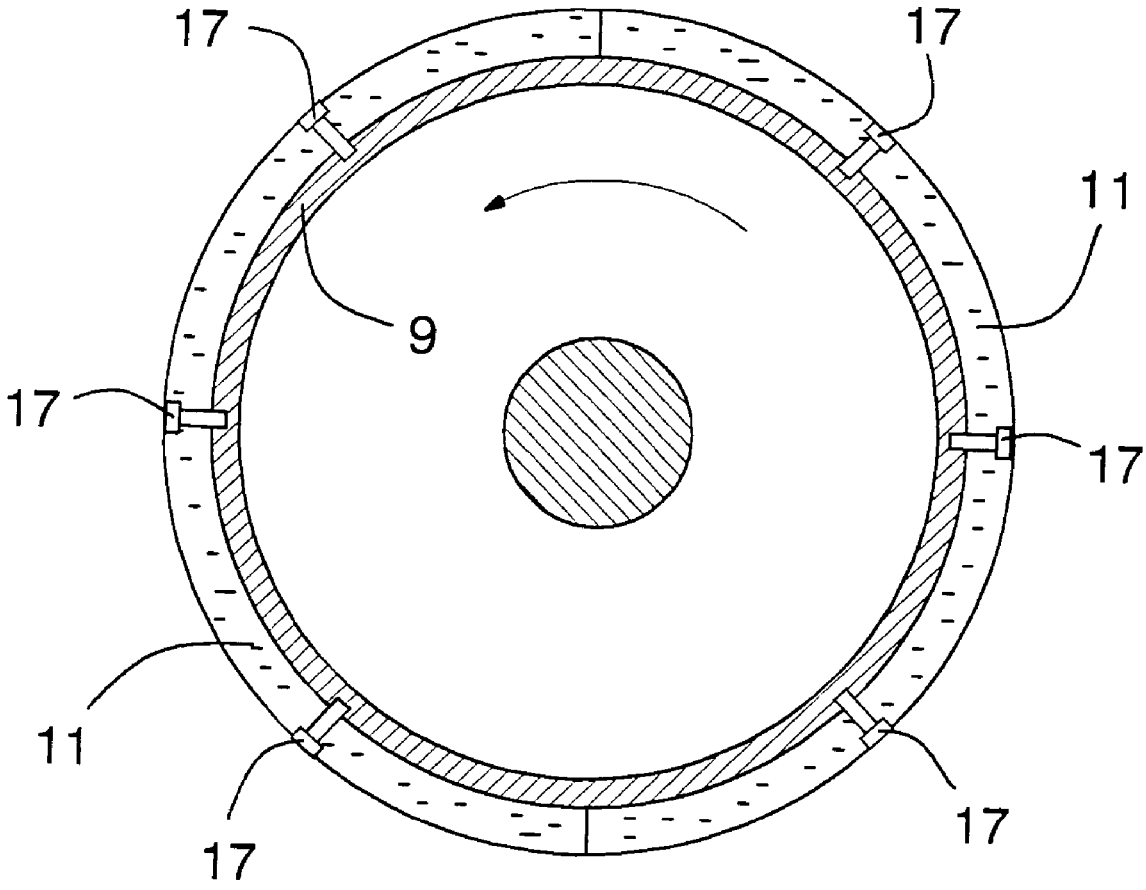

The invention will be described in more detail in the accompanying drawings, in which FIG. 1 shows schematically a grinding apparatus, where a grinding segment according to the invention can be used, FIG. 2 is a schematic end view of a prior art grinder stone, FIG. 3 is a schematic side view of a part of the prior art grinder stone, FIG. 4 is a schematic top view of a grinding element according to the invention, FIGS. 5 to 9 are schematic sectional views of grinding elements according to the invention, viewed from the direction of the stone shaft, and FIG. 10 is a schematic end view of a grinder stone according to the invention.

DETAILED DESCRIPTION OF THE INVENTION

FIG. 1 shows a grinding apparatus for detaching fibers from logs 1 or some other similar wood material by means of a rotating cylindrical grinder stone 2. The logs 1 are pressed by feeder means, such as feed cylinders 3, from a feed chamber 4 against the outer surface of the grinder stone 2. Water is simultaneously supplied from nozzles 6 to a grinding chamber 5. The fiber that has been released from the logs accumulates with the sprayed water in a grinder pit 7 at the bottom of the grinding chamber and is conducted therefrom to subsequent processing steps. The grinding apparatus is considered fully known to a person skilled in the art, wherefore the structure and operation thereof do not have to be described in more detail herein.

FIG. 2 shows, in a simplified manner, a prior art grinder stone 2, which rotates around a shaft 8. The grinder stone comprises a preferably metal cylindrical frame 9, the outer circumference of which is provided with individual grinding segments 10 typically made of ceramic, a suitable ceramic mixture or some other corresponding material, and positioned adjacent to one another. The segments thus constitute a grinding surface 30 of the grinder stone that processes the wood. FIG. 3 is a side view of a part of the grinder stone. The segments are typically rather large and heavy, and thus attaching the segments firmly to the frame of the grinder stone has proved to be difficult. If a large and heavy segment comes off the grinder stone for some reason during use, it can produce serious damage to the grinding apparatus and cause a safety risk. Furthermore, since each segment is separately fastened to the grinder stone, it is difficult to replace segments.

FIG. 4 is a top view of a grinding element 11 according to the invention. The grinding element shown in the figure is rectangular, but it is clear that the shape and the size of the grinding element can vary in each situation. The grinding element comprises a substantially planar fastening frame 12, the first surface 14 of which is positioned against the frame 9 of the grinder stone, and the second, opposite surface 13 of the fastening frame being provided with a sufficient number of grinding segments 10 fastened so as to cover substantially the entire second surface of the element, thus forming together the grinding surface of the element. The area of the second surface 13 of the fastening frame is greater than the area of an individual grinding segment 10, wherefore several, typically 5 to 10 grinding segments are needed per one grinding element. Each segment is manufactured of ceramic or some other corresponding material that is suitable for grinding. The figure shows rectangular segments, but it is clear that the shape and the size of the segments can be selected suitably in each case. If required, the grinding element can comprise segments of various sizes. The joints between the segments are preferably positioned in different locations when viewed at least in one direction, as shown in the figure. The joints between the segments carry with them the wood fiber that has been detached during grinding, and therefore the grinding surface of the segments does not have to be provided with grooves.

The grinding segments are fastened to the second surface of the fastening frame by means of bonding agent 15, wherefore the segments need not be provided with fastening holes, nor do they require mechanical fastening means. The bonding agent can be any suitable plastic material, such as polyphenylene sulphide (PPS), polyether imide (PEI), vinyl ester-polyurethane (VEUH), vinyl ester (VE), polyurethane (PUR), polystyrene (PS), polyamide (PA), and epoxy resins. The bonding agent can also consist of a mixture of polyurethane (PUR) and polyester, or a mixture of some other resins, i.e. a hybrid resin. If required, the bonding agent can be reinforced with fiber or it can contain filler. The fiber reinforcement can consist of any suitable fiber material, such as a glass fiber mat or a glass fiber mesh, staple glass fiber, milled glass fiber, kevlar, carbon fiber or some other suitable fiber material. The filler can be aluminium oxide, silica sand, kaolin, talc or some other suitable filler. It is also possible to use e.g. metal solder or different concrete types as bonding agent.

Figure 5:
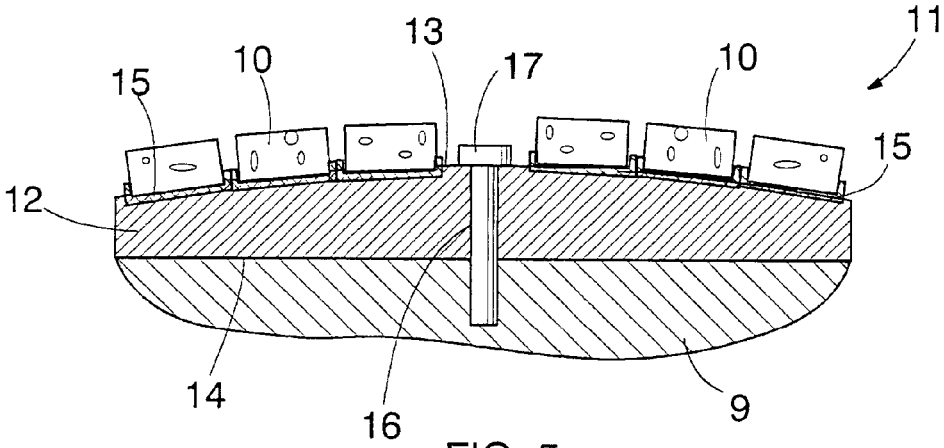
Figure 6:
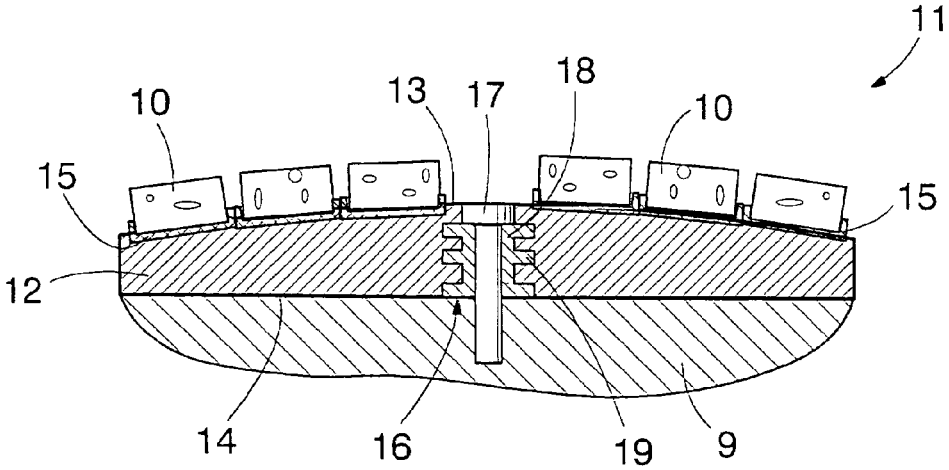

In addition to the bonding agent 15 acting as an adhesive between the segment 10 and the fastening frame 12, the plastic layer of bonding agent can also damp vibration and percussive loads at the bottom of the segments. Furthermore, the layer of bonding agent can compensate for varying dimensions resulting from the thermal expansion of the segment and the fastening frame. As shown in FIGS. 5 and 6, a proportion of the transverse sides of the segments can also be provided with layers of bonding agent, beginning from the bottom of the segments.

FIGS. 5 and 6 show that the second surface 13 of the fastening frame is curved. The first surface 14 of the fastening frame is straight, or it is alternatively curved and corresponds to the shape of the frame 9 of the grinder stone. In the first case, the outer circumference of the stone's frame is provided with planar surfaces, parallel to the shaft of the stone, for fastening the elements. One or more fastening holes 16 extend through the fastening frame, and fastening bolts 17 are supplied through the holes to fasten the grinding element 11 to the frame of the grinder stone. In FIG. 5, the frame of the grinding element is made of steel, concrete or some other similar material capable of receiving the fastening forces. Furthermore, the fastening frame can be provided with a thread, and the fastening bolt is screwed from the side of the stone's frame. Other fastening means, such as suitable wedge mechanisms, can also be used.

In FIG. 6, the fastening frame 12 of the grinding element is made of plastic, such as polyphenylene sulphide (PPS), polyether imide (PEI), vinyl ester-polyurethane (VEDUH), vinyl ester (VE), polyurethane (PUR), polystyrene (PS), polyamide (PA), and epoxy resins. If required, the bonding agent can be reinforced with fiber or it may contain filler. The plastic fastening frame is also provided with fastening sleeves 18, made of metal or some other firm material, which coincide with the fastening holes 16, and the fastening bolts 17 being arranged through the fastening sleeves. The fastening bolt tightens the fastening sleeve to the frame of the grinder stone, wherefore the plastic fastening frame will not be subjected to any significant compression stresses resulting from the fastening. The fastening sleeve can be a separate element to be installed in place after the fastening frame has been cast. Alternatively, the fastening sleeve is arranged in the mold and the fastening frame is cast around it, so that the sleeve will be integrated with the frame. In such a case the fastening sleeve can be provided with protrusions 19, which ensure that the sleeve is properly fastened to the plastic material. Furthermore, since the fastening bolt and the fastening sleeve are preferably manufactured of the same material, which is typically steel, thermal expansion is under control and no expensive special bolts are needed to balance the varying dimensions. It is also possible to arrange both the fastening sleeve and the grinding segments in the mold and to thereafter cast the fastening frame from the plastic material. The plastic material of the fastening frame thus acts as bonding agent, which joins the segments to the fastening frame. The casting can be for example die-casting.

Figure 7:
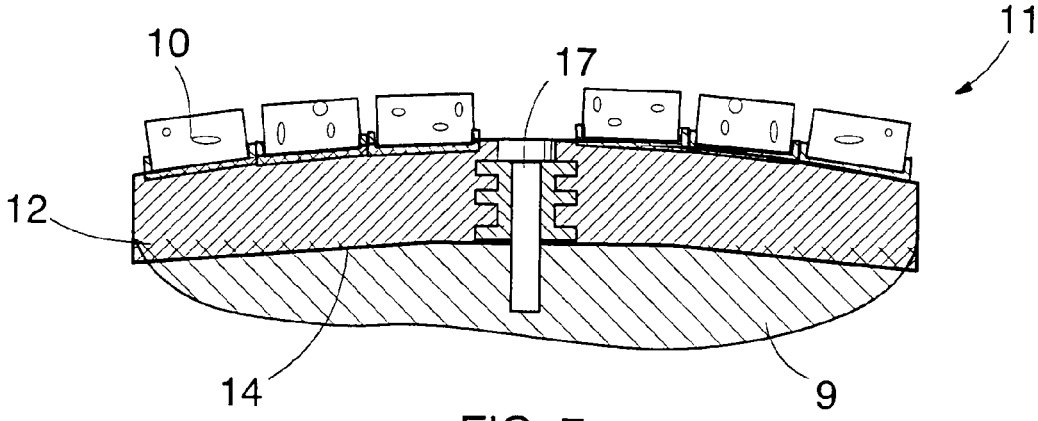
Figure 8:
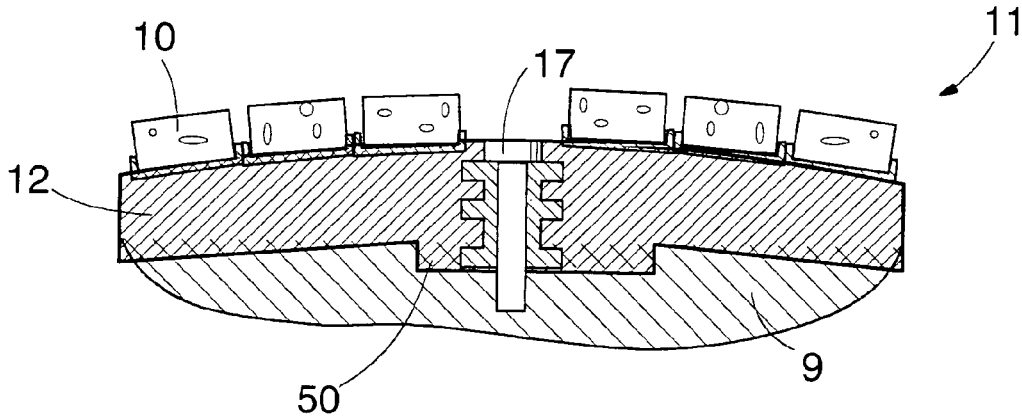
Figure 9:
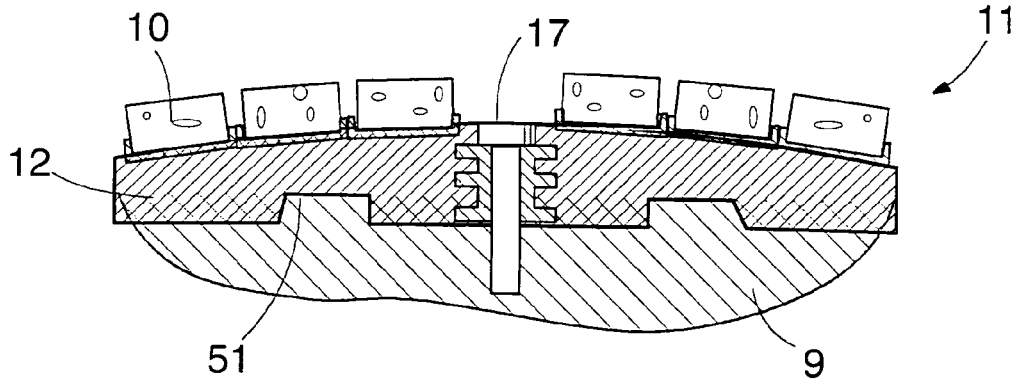

FIG. 7 shows that the first surface 14 of the fastening frame of the grinding element can be curved, if the frame 9 of the grinder stone is cylindrical. FIG. 8 further shows one or more protrusions 50 formed on the first surface of the fastening frame and arranged in a recess formed in the frame 9 of the grinder stone, so that the forces acting on the grinding element, such as shear forces, are transmitted via the protrusion to the frame of the grinder stone. Such a locking mechanism based on the shapes also prevents the grinding element from turning with respect to the frame of the grinder stone. Therefore the fastening means of the grinding element will not be subjected to such high stresses, and the fastening will be firm. Alternatively, the first surface of the grinding element can comprise one or more recesses 51, and the outer surface of the stone's frame 9 is thus provided with suitable protrusions. FIG. 10 is an end view of a grinder stone according to an embodiment of the invention, where the frame 9 of the grinder stone is cylindrical and the grinding surface is formed of two grinding elements 11 arranged on the outer circumference of the stone.

The drawings and the related description are only intended to illustrate the inventive idea. The details of the invention can vary within the scope of the claims. Therefore, even though the figures show the invention in connection with a grinder stone of a steel frame, the invention can also be applied in grinder stones with a frame of concrete. Furthermore, the shape and the size of the grinding element can be selected suitably in each case.

That which is claimed:

1. A grinding element adapted to be arranged on an outer surface of a frame for a grinder stone used to defiber wood, the grinding element comprising:

a fastening frame having a first surface configured to operably engage the frame of the grinder stone and an opposed second surface;

a fastening device configured to operably engage the fastening frame and to secure the fastening frame to the frame of the grinder stone; and a plurality of grinding segments, each defining an area smaller than the second surface of the fastening frame and being comprised of a ceramic grinding material, the grinding segments being fastened to the fastening frame with a bonding agent disposed between the grinding segments and the second surface so as to secure the grinding segments to the second surface, the minding segments cooperating to substantially cover the second surface of the fastening frame and to form at least a portion of a grinding surface of the grinder stone.

2. A grinding element according to claim 1, wherein the first surface of the fastening frame is substantially planar.

3. A grinding element according to claim 1, wherein the fastening frame is comprised of a plastic material.

4. A grinding clement according to claim 3, further comprising a fastening sleeve operably engaged with the fastening frame and defining a fastening hole, the fastening sleeve being configured to receive the fastening device through the fastening hole such that the fastening frame is secured to the frame of the grinder stone via the fastening sleeve.

5. A grinding element according to claim 1, wherein the bonding agent is comprised of at least one of a plastic material and a fiber-reinforced material.

6. A grinding element according to claim 1, wherein each grinding segment includes a side surface and the bonding agent extends at least partially between opposing sides of adjacently-disposed grinding segments on the fastening frame.

7. A grinding element according to claim 1, wherein the first surface of the fastening frame includes at least one of a protrusion and a recess, the outer surface of the grinder stone frame being configured to be complementary with respect to the first surface and to have the fastening frame secured thereto such that forces produced during a grinding process are transmitted from the respective grinding element to the grinder stone frame.

8. A grinding element according to claim 1 wherein the fastening frame is secured to the frame of the grinder stone by a single fastening device.

9. A grinding element according to claim 1 wherein the plurality of grinding segments are arranged in a staggered pattern on the second surface of the fastening frame.

10. A grinder stone adapted to defiber wood, comprising:

a grinder stone frame defining an outer surface and adapted to be rotatable about a shaft; and a plurality of grinding elements operably engaged with the outer surface of the grinder stone frame such that the grinding elements cooperate to form a substantially cylindrical grinding surface of the grinder stone, each grinding element comprising:

a fastening frame having a first surface configured to operably engage the frame of the grinder stone and an opposed second surface;

a fastening device configured to operably engage the fastening frame and to secure the fastening frame to the grinder stone frame; and a plurality of grinding segments, each defining an area smaller than the second surface of the fastening frame and being comprised of a ceramic grinding material, the grinding segments being fastened to the fastening frame with a bonding agent disposed between the grinding segments and the second surface so as to secure the grinding segments to the second surface, the grinding segments cooperating to substantially cover the second surface of the fastening frame and to form at least a portion of a grinding surface of the grinder stone.

11. A grinder stone according to claim 10, wherein the first surface of the fastening frame is substantially planar.

12. A grinder stone according to claim 10, wherein the fastening frame is comprised of a plastic material.

13. A grinder stone according to claim 12, further comprising a fastening sleeve operably engaged with the fastening frame and defining a fastening hole, the fastening sleeve being configured to receive the fastening device through the fastening hole such that the fastening frame is secured to the grinder stone frame via the fastening sleeve.

14. A grinder stone according to claim 10, wherein the bonding agent is comprised of at least one of a plastic material and a fiber-reinforced material.

15. A grinder stone according to claim 10, wherein each grinding segment includes a side surface and the bonding agent extends at least partially between opposing sides of adjacently-disposed grinding segments on the fastening frame.

16. A grinder stone according to claim 10 wherein the first surface of the fastening frame includes at least one of a protrusion and a recess, the outer surface of the grinder stone frame being configured to be complementary with respect to the first surface and to have the fastening frame secured thereto such that forces produced during a grinding process are transmitted from the respective grinding element to the grinder stone frame.

17. A grinder stone according to claim 10 wherein the fastening frame is secured to the frame of the grinder stone by a single fastening device.

18. A grinder stone according to claim 10 wherein the plurality of grinding segments are arranged in a staggered pattern on the second surface of the fastening frame.

* * * * *

UNITED STATES PATENT AND TRADEMARK OFFICE

CERTIFICATE OF CORRECTION

PATENT NO. : 7,000,859 B2
APPLICATION NO. : 10/662630
DATED : February 21, 2006
INVENTOR(S) : Tuovinen It is certified that error appears in the above-identified patent and that said Letters Patent is hereby corrected as shown below:

Column 6,
Line 31, “minding” should read --grinding--;
Line 39, “clement” should read --element--.

Signed and Sealed this

Twenty-first Day of November, 2006

JON W. DUDAS
*Director of the United States Patent and Trademark Office*